United States Patent [19]

Ramaciere

[11] 4,149,662

[45] Apr. 17, 1979

[54] WRIST WATCH BAND

[76] Inventor: Romuald Ramaciere, 11624 Pinedale Ave., Seminole, Fla. 33542

[21] Appl. No.: 858,969

[22] Filed: Dec. 9, 1977

[51] Int. Cl.[2] ..... A44C 5/14

[52] U.S. Cl. ..... 224/164; 24/265 B

[58] Field of Search ..... 224/4 D, 4 E, 4 R, 4 C, 224/4 K, 28 W, 28 R; 24/265 B, 265 WS, 73 WW, 87 R; 63/21

[56] References Cited

U.S. PATENT DOCUMENTS

| | | | |
|---|---|---|---|
| 2,461,693 | 2/1949 | McAloon | 24/265 B |
| 2,713,445 | 7/1955 | Speck | 224/4 D |
| 3,477,107 | 11/1969 | Nadeau | 24/265 B |
| 3,578,208 | 5/1971 | Herzog | 224/4 E |

*Primary Examiner*—Trygve M. Blix
*Assistant Examiner*—Kenneth W. Noland
*Attorney, Agent, or Firm*—Arthur A. Johnson

[57] ABSTRACT

Each end of a flexible non-metallic band to be attached to a wrist watch case is divided into two terminal tabs by a central longitudinal slit through the folded-over end portion of the band, the length of the slit being sufficient to permit the tabs when spread apart to fit between more or less widely spaced band-attaching lugs on watch cases and so that when moved toward each other they will engage and fit between such lugs when closely spaced, a rigid bushing being inserted in a tunnel formed by the folded-over end portion of each of the tabs; extending through the bushings is a coiled wire spring having end portions which extend into said bushings and are biased to force said bushings and terminal tabs apart sufficiently to fit between widely spaced lugs and said spring yielding to permit the terminal tabs to fit between lugs which are closer, the portion of the spring exposed between the terminal tabs, when said latter are spread apart, being tightly wound turn against turn, the tabs being attached to the lugs by conventional expanding pins extending through the coiled wire spring and into sockets formed in the lugs.

2 Claims, 6 Drawing Figures

WRIST WATCH BAND

This invention relates to improved flexible, non-metallic wrist bands for wrist watch cases.

An object of this invention is to provide a flexible, non-metallic wrist band for connection to band-attaching lugs on a wrist watch case, the ends of the band being easily extended or contracted to fit between the band-attaching lugs which may be widely or narrowly spaced depending on the particular watch case to be fitted with a band.

The objects of this invention are accomplished in part by providing on the watch-receiving ends of a non-metallic wrist band means for increasing or decreasing the effective width of the ends of the band depending on the space between the band-attaching lugs on the particular watch case being fitted with a watch band. As a result, a watch dealer need not carry in stock wrist bands of any one style of two or more different widths. This is particularly important when replacement bands are required by the customer whose watch case has band-attaching lugs having an odd size space between them.

Solutions to this problem have been suggested for use with metallic watch bands, but so far as is known, the solution of the problem has not, heretofore, been found with regard to making of flexible leather, plastic or textile fabric wrist bands.

For instance, as shown in U.S. Pat. No. 3,477,107 there is a metal tube having slidable mounting pin blocks which are spring-urged outwardly more or less depending on the space between the mounting lugs on the watch. However, gaps are formed between the edges of the metal band and the edges of the attaching lugs.

Another example of a proposed wrist band for wrist watches is shown in U.S. Pat. No. 3,702,670 in which the band is made of mesh strands which during manufacture are compressed and laterally spread out, the spread-out strands having secured to them by spot welding an ornamental plate which is not expandable or contractible. The problem of making a non-metallic wrist band fit between attaching lugs of different spacing was not solved by this patent.

According to the present invention a solution has been found by selecting a flexible non-metallic watch band having a width approximately equal to the space between the most closely spaced lugs, forming at the end of the band a longitudinal slit or slot midway between the lateral edges of the band through and inwardly from a folded-over end and for a distance which will allow tabs thus formed to be spread apart to engage the widest spaced lugs to be accommodated and providing spring means for urging the tabs apart.

Other features and advantages will hereinafter appear.

Figure 1:
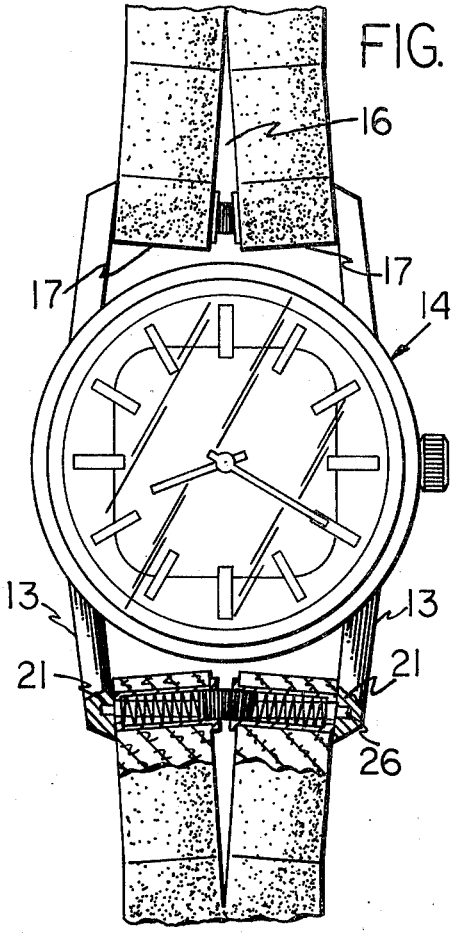
FIG. 1 is a plan view of a wrist watch in which the case has band-attaching lugs which are closely spaced from each other, one pair of terminal tabs being shown in section.
Figure 2:
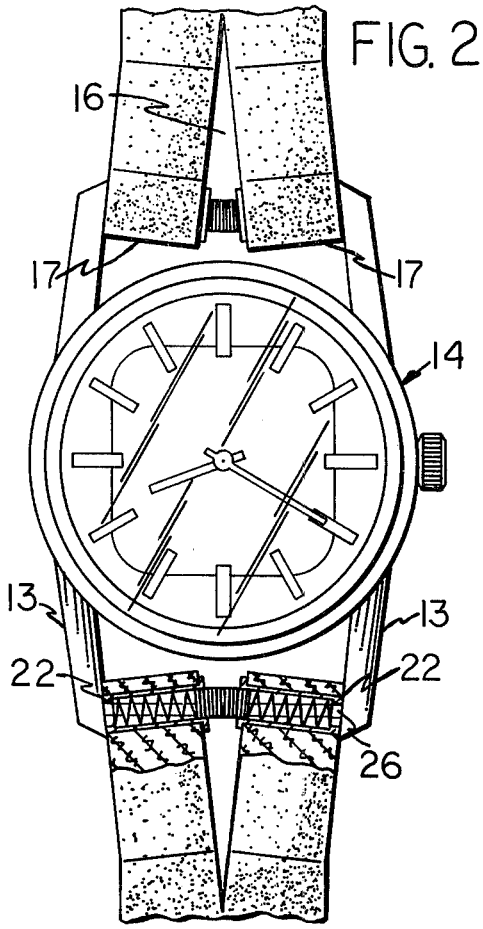
FIG. 2 is a similar view in which the attaching lugs are more widely spaced.
Figure 3:
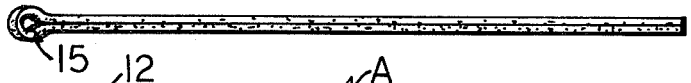
FIG. 3 is an edge view of one portion of the band showing the tunnel to receive the bushing.
Figure 4:
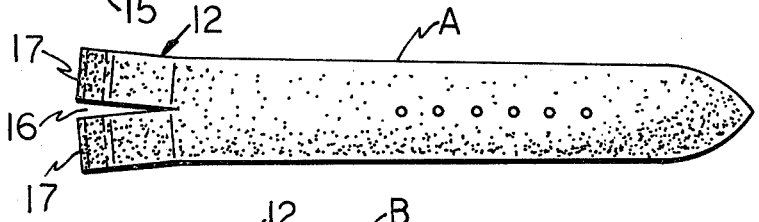
FIG. 4 is a plan view of the one of a pair of straps making up the band.
Figure 5:
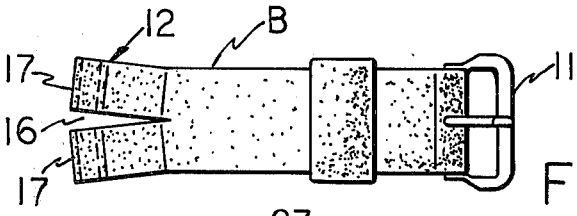
FIG. 5 is a similar view of the other strap of the band.
Figure 6:
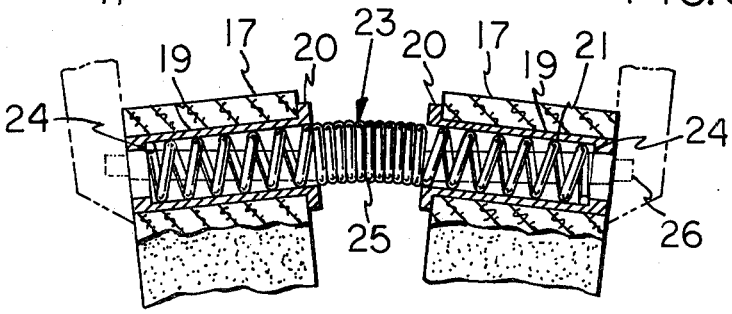
FIG. 6 is an enlarged sectional view of the band-attaching means of the present invention showing the expanding pins which engage the lugs to secure the band to the watch case.

As shown in the accompanying drawing, the removable and replaceable wrist band for wrist watches is of the type in which there are two sections A and B having their meeting ends secured together in adjusted position by a buckle 11 and their other ends 12 each secured to a pair of spaced band-attaching lugs 13, one pair projecting from the top of the watch case 14 and the other pair projecting from the bottom thereof, to which lugs 13 the unbuckled ends of the band are detachably connected.

This arrangement is made so that a purchaser or owner of a wrist watch may select from a variety of wrist bands the one he desires to be fitted to his watch.

Heretofore, it has been general practice for dealers to carry in stock wrist bands having various widths to fit neatly between the band-attaching lugs 13 of the purchaser's watch which involved for the merchant tying up considerable capital.

The wrist band of the present invention is formed of flexible material such as leather or leather-like material, plastic or textile fabric. Regardless of the material, each watch case-engaging end of the band of the present invention comprises a folded-over strip of the selected material adhered together by adhesive except where the fold is made which forms a tunnel 15. After the strips are adhered together, the end portion of each strip is provided with an elongate cut or slit 16 forming terminal tab portions 17. Due to the flexibility of the material of the band, relative lateral and edgewise movement of the tabs away from each other may be produced.

Initially the width of the band is substantially equal to the distance between the most narrowly spaced lugs 13 and the length of the slit 16 is such that the tab portions 17 can be spread apart to engage the most widely spaced lugs 13 usually found on wrist watch cases.

Inserted in each of the tunnels 15 of the tab portions 17 there is a bushing 19 having on one end a flange 20 limiting the extent of movement of the bushing 19 into the tunnel 15 of the terminal tab 17.

Within the bushings 19 there is provided a coil spring 23 which is long enough to engage inwardly extending flanges 24 at the outer ends of the bushings. The spring 23 is biased to have sufficient force to cause the terminal tabs 17 to spread apart for a distance slightly more than the distance between the most widely spaced attachment lugs 13 on watch cases. The central portion 25 of the spring 23 which is exposed between the tabs 17 when the latter are spread apart, is tightly wound turn against turn.

In assembling the spring 23 in the bushings in the tabs 17, this operation may be facilitated by inserting one end of the spring 21 in one of the bushings 19 and then extending the slit portion of the strip, allowing the other end of the spring to enter the bushing 19 in the other tab.

To secure the ends of the band to the watch case, the conventional spring pin assembly 26 is placed in the spring 23 and compressed so that the ends may enter the holes in the lugs 21 and then expand.

As suggested above, when the bands are made of laminated strips of textile fabric, the edges of the slit 16 may be protected from unraveling by being coated with an adhesive either before or after the slit is made. Or the strips may be made of nylon or thermoplastic material, in which case the overlying parts of the laminated strips may be secured together by heat.

Variations and modifications may be made within the scope of the claims and portions of the improvements may be used without others.

I claim:

1. In a flexible non-metallic wrist band for attachment to a wrist watch case which has a pair of spaced band-attaching lugs and having aligned spring bar receiving sockets in their facing surfaces and a spring bar having its ends engaged in said sockets, each case-engaging end of the band being folded over and secured to an underlying portion of the band except at the line of fold to form a tunnel, the improvement comprising each folded-over end portion of the band being divided to form a pair of terminal tabs by a central longitudinal slit through the folded-over end portion of the band, the length of each slit being sufficient to permit said pair of terminal tabs when spread apart to fit between and engage wide-spaced band-attaching lugs and when moved together more or less to fill the space between said lugs when the latter are not so widely spaced, a pair of rigid bushings each having an outwardly extending terminal flange at one end and an inwardly extending terminal flange at the other end, one of said pair of bushings being inserted in the tunnel of each of said tabs, and said outwardly extending terminal flanges engages an end of each of said tabs adjacent the slit, a coiled wire expansion spring extending through both of said aligned pairs of terminal tabs, the ends of said spring extending across the space between and into said bushings and being biased to engage said inwardly extending terminal flanges and force said terminal tabs apart sufficiently, if necessary, to cause the outer edges of said terminal tabs to engage the band-attaching lugs of a particular watch case being fitted with the band, said spring yielding to permit the terminal tabs to be moved together more or less to fit between more closely spaced lugs, the internal diameter of said expansion coil spring and bushings being such as to permit said spring bar supplied with the watch case to pass through said expansion spring and into said sockets.

2. A flexible non-metallic band for attachment to a wrist watch case according to claim 1 in which the portion of the spring exposed between the terminal tabs, when the latter are spread apart, being tightly wound, turn against turn, to fill the space between adjacent edges of said terminal tabs.

* * * * *